United States Patent [19]

Tanaka et al.

[11] 4,194,020

[45] Mar. 18, 1980

[54] METHOD FOR PREVENTING DEGRADATION OF A LIQUID DEVELOPER FOR ELECTROSTATIC RECORDING

[75] Inventors: Hiroshi Tanaka, Tokyo; Terukuni Tsuneda, Matsudo, both of Japan

[73] Assignee: Canon Kabushiki Kaisha, Tokyo, Japan

[21] Appl. No.: 822,339

[22] Filed: Aug. 5, 1977

Related U.S. Application Data

[63] Continuation of Ser. No. 555,088, Mar. 4, 1975, abandoned.

[30] Foreign Application Priority Data

May 8, 1974 [JP] Japan ..... 49-27616

[51] Int. Cl.[2] ..... G03G 13/10; G03G 13/16

[52] U.S. Cl. ..... 430/119; 430/32; 430/126; 162/138

[58] Field of Search ..... 427/24, 121, 16, 17; 96/1.4, 1 LY; 162/138

[56] References Cited

U.S. PATENT DOCUMENTS

| | | | |
|---|---|---|---|
| 2,684,300 | 7/1954 | Wilson et al. | 162/180 |
| 3,110,621 | 11/1963 | Doggett et al. | 427/121 |
| 3,486,889 | 12/1969 | Bobalek et al. | 162/138 |
| 3,861,954 | 1/1975 | Funderburk | 162/138 |
| 3,892,887 | 7/1975 | Shibata et al. | 427/121 |
| 3,933,489 | 1/1976 | Walters | 427/24 |

*Primary Examiner*—Ronald H. Smith
*Assistant Examiner*—Stuart D. Frenkel
*Attorney, Agent, or Firm*—Fitzpatrick, Cella, Harper & Scinto

[57] ABSTRACT

Degradation of a liquid developer for developing electrostatic latent images is prevented by using a paper from which a rosin aluminum soap is not substantially eluted into the liquid developer when contacted therewith.

4 Claims, No Drawings

METHOD FOR PREVENTING DEGRADATION OF A LIQUID DEVELOPER FOR ELECTROSTATIC RECORDING

This is a continuation of application Ser. No. 555,088 filed Mar. 4, 1975, now abandoned.

BACKGROUND OF THE INVENTION

1. Field of the Invention

This invention relates to a method for preventing degradation of a liquid developer for electrostatic recording caused by contacting with paper and further to photosensitive paper, electrostatic recording paper and transfer paper.

2. Description of the Prior Art

Heretofore, various electrostatic recording methods utilizing liquid development have been known. For example, there may be mentioned a method comprising developing electrostatic latent image formed on a ZnO photosensitive paper with a liquid developer, a method comprising developing electrostatic latent images formed on an electric charge retaining layer of an electrostatic recording paper with a liquid developer, and a method comprising developing electrostatic images formed on a selenium photosensitive layer or an insulative layer with a liquid developer and then transferring the developed images in the presence of a carrier liquid.

In the electrostatic recording methods as mentioned above, the liquid developer inevitably contacts the photosensitive paper, electrostatic recording paper, or transfer paper in the developing step or transferring step. In general, the liquid developer having contacted the paper is recovered and used again for the subsequent development. During repeated use of the liquid developer, it is deteriorated and results in lowering image density and finally it can not be used any more. Such degradation is remarkable when a negatively chargeable liquid developer is used.

In general, a liquid developer for electrostatic recording contains dye, pigment, a fixing agent, a dispersing agent, a charge control agent and the like in a highly insulating carrier liquid in a form of dispersion or solution, and it is known that the liquid developer is deteriorated due to degradation of such materials by oxidation and heat.

It has been found that the degradation due to the repeated use of the liquid developer is still caused in the electrostatic recording methods comprising contacting a paper with a liquid developer even when a liquid developer containing materials which are not easily degraded is used.

The present inventors have found as the result of chemical analysis of the liquid developer deteriorated by repeated use that a substance accelerating the degradation sheds into the carrier liquid from the photosensitive paper, electrostatic recording paper and transfer paper.

SUMMARY OF THE INVENTION

According to the present invention, there is provided a process for preventing degradation of a liquid developer for developing electrostatic latent images comprising contacting a paper with the liquid developer for developing electrostatic latent images and using said liquid developer repeatedly in which a rosin aluminum soap is not substantially eluted from the paper into said liquid developer when the paper is contacted with said liquid developer.

According to another aspect of the present invention, there is provided a photoconductive photosensitive paper having a photoconductive layer on a base paper in which a rosin aluminum soap is not eluted from the base paper when the photosensitive paper is contacted with a liquid developer for electrostatic images.

According to a further aspect of the present invention, there is provided an electrostatic recording paper having an electric charge retaining layer on a base paper in which rosin aluminum soap is not substantially eluted from the base paper when the paper is contacted with a liquid developer for electrostatic latent images.

According to still another aspect of the present invention, there is provided a transfer paper for receiving images developed with a liquid developer for electrostatic latent images which comprises a paper from which a rosin aluminum soap is not substantially eluted when the paper is contacted with the liquid developer.

An object of the present invention is to provide a method for preventing degradation of a liquid developer in case of repeated use of the liquid developer contacting a photosensitive paper, electrostatic recording paper, or transfer paper.

Another object of the present invention is to provide a photosensitive paper, electrostatic recording paper, or transfer paper which does not deteriorate a liquid developer upon contacting the liquid developer.

A further object of the present invention is to provide a method for preventing degradation of a liquid developer for electrostatic recording by using a photosensitive paper, electrostatic recording paper or transfer paper from which a rosin aluminum soap does not shed into a carrier liquid.

Still another object of the present invention is to provide a photosensitive paper, electrostatic recording paper or transfer paper from which a rosin aluminum soap does not shed into a carrier liquid and which does not deteriorate the liquid developer.

DESCRIPTION OF THE PREFERRED EMBODIMENTS

The present inventors have found that the rosin aluminum soap extracted from repeatedly used and deteriorated liquid developers originates from a rosin sizing agent and aluminum sulfate widely used in the conventional paper sizing. In general, almost all commercially available paper contains a rosin aluminum soap. The present inventors have found that the rosin aluminum soap eluted from the paper to the liquid developer deteriorates the liquid developer. Based on this discovery, the present inventors used a paper having a sizing agent other than rosin aluminum soaps to prepare a photosensitive paper, electrostatic recording paper or transfer paper and repeated the liquid development, and degradation of the liquid developer was lowered to a great extent to give always stable images.

The present inventors have further investigated the relation between rosin aluminum soap in the paper and degradation of liquid developers in detail.

Usual rosin aluminum soaps produced from a rosin sizing agent and aluminum sulfate are classified into groups, i.e. aluminum mono-rosinate and aluminum di-rosinate. The present inventors have found that the former is not soluble in a carrier liquid of a liquid developer and therefore, it has nothing to do with the degradation while the latter is dissolved in the above mentioned carrier liquid to deteriorate the liquid developer. In view of this discovery, the present inventors have succeeded in lowering degradation of a liquid developer to a great extent upon sizing with a rosin size and aluminum sulfate by preventing the elution of rosin aluminum soaps into a carrier liquid by selecting the molar ratio of rosin size to aluminum sulfate of not higher than an equimolar ratio, preferably, from ½ to 1/5.

According to the present invention, the degradation of a liquid developer may be prevented by using a sizing agent other than rosin size or by suppressing the elution of rosin aluminum soap from the paper into the liquid developer by employing some processing or treatment. In conclusion, it is sufficient to control the elution of rosin aluminum soap into a carrier liquid to an extent that the eluted rosin aluminum soap does not deteriorate the liquid developer.

Naturally, it is most preferable to completely prevent the elution of rosin aluminum soap into the carrier liquid. However, during repeated use, a liquid developer is also deteriorated by various causes other than the eluted rosin aluminum soap and it becomes inevitable to discard the liquid developer. Therefore, such a minor elution of rosin aluminum soaps that does not completely deteriorate a liquid developer before the liquid developer is completely deteriorated by other causes is acceptable. The present inventors have made various experiments and found that a paper such as photosensitive paper, electrostatic recording paper or transfer paper capable of passing the following test (hereinafter called "elution test") is practically satisfactory. In one liter of a carrier for a liquid developer to be used (for example, Isopar H, an isoparaffine series hydrocarbon) are immersed 200g of small pieces of a photosensitive paper, electrostatic recording paper or transfer paper, and stood for 24 hours at room temperature and then the amount (mg.) of rosin aluminum soap eluted into one liter of the carrier liquid is determined. According to the above test, a paper fromwhich the amount of rosin aluminum soap eluted is not more than 20 mg., preferably, not more than 10 mg. is effective to prevent the degradation of a liquid developer. However, it is quite natural that a paper from which the rosin aluminum soap does not shed at all is employed.

Representative effective sizing agents which do not form rosin aluminum soap may be a condensate of epichlorohydrin with an aliphatic primary amine, hardened fatty acid soap, dimer of alkylketene such as tetradecyl ketene, hexadecyl ketene and the like, sodium salt of carboxymethylcellulose, wax such as paraffine wax, micro-crystalline wax, vegetable wax, polyethylene wax, montan wax and the like, petroleum therein a a reaction product of terpene resin and acrylonitrile, organic silicon compound such as triacetoxy silane, polyalkylhydroxy silane, methyl silicon resin and the like, asphalt emulsion, pitch, hydrophobic polyfunctional amine salt, algin, alkylene imine resin, cyclic petroleum oil, cyclic dicarboxylic acid anhydride, a reaction product of a monocarboxylic acid with dialkanol amine or trialkanol amine, a condensate of alkylamine with methylene-bisacrylamide, tall oil, hydrogenated tall oil, maleic tall oil, saponified dodecenyl succinic anhydride, modified petroleum resin, and a mixture of hydrogenated animal fat or casein with aqueous ammonia or sodium hydroxide.

The abovementioned sizing agents are used in place of conventional rosin size to produce a base paper. The resulting base paper may be processed by a known method to produce a transfer paper, photoconductive photosensitive paper or electrostatic recording paper. For example, before applying a photoconductive layer or electric charge retaining layer to the base paper, the base paper may be subjected to a treatment for controlling electric resistance and/or a treatment for improving the surface properties such as coating property and the like.

The liquid developer for electrostatic recording in the present invention may be a conventional liquid developer for visualizing electrostatic latent images. In general, it may be a high insulating liquid, for example, an organic solvent having volume resistivity of not lower than $10^9$ ohm-cm. and dielectric constant of not higher than 3, containing dispersed therein a toner such as charged fine particles.

The invention will be understood more readily by reference to the following examples. However, these examples are intended to illustrate the invention and are not to be construed to limit the scope of the invention.

EXAMPLE 1

To the starting material consisting of 20 parts of a softwood bleached kraft pulp (N.BKP) and 80 parts of a hardwood bleached kraft pulp (L.BKP) which were beat to a freeness of 300 ml. were added 1.0 part of rosin size, 0.73 part of aluminum sulfate and 8 parts of talc to make a base paper having a base weight of 60 g/m$^2$ by using a Fourdrinier paper machine. A size press solution of the under-mentioned composition was coated onto the base paper thus made in an amount of 3 g/cm$^2$ as solid by means of a size press to obtain a transper paper "A" having a Gurley densometer reading of 5400 seconds, a curl of 7 mm and a hold-out of 10 seconds, which was as conventionally used.

Composition of the size press solution:

Emulsion of a copolymer of 50 mole% of ethyl acrylate and 20 mole% of methyl methacrylate and 30 mole% of acrylic acid . . . 70 parts Methyl cellulose (Methorcse 658 H, a trade name of a product of Shinetsu Kagaku K.K.) . . . 0.5 paart Clay . . . 30 parts Melamine resin (Sumilez 613, a trade name of a product of Sumitomo Kagaku K.K.) . . . 0.5 part Antifoaming agent (a silicone type) . . . 0.1 part Dispersing agent (Plimal 850, a trade name of a product of Nippon Akuriru K.K.) . . . 0.02 part Water . . . 900 parts In the meantime, another base paper was made by repeating the same procedure as that in making the above-mentioned base paper except that a condensate obtained from 1.5 mole of epichlorohydrin and 1 mole of oleyl amine was substituted for the rosin size; followed by heating and drying under a weak alkaline condition. The base paper was further treated by using a size press in the same manner as that in case of the transfer paper "A" to prepare a transfer paper "B" according to this invention.

The transfer paper "B" thus prepared as well as the transfer paper "A" were used to conduct a comparison test in the following manner.

With a roll mill, 39 g of carbon black, 200 g of XPL2005 (a trade name of a polyester resin of Kao Atlas K.K.) and 40 g of Piccolyte S-115 (a trade name of polyterpene resin of Esso Standard Oil. Co.) were kneaded, and then 300 g of the kneaded mixture was dispersed in 800 g of Isopar H (a trade name of a isoparaffin type hydrocarbon of Esso Standard Oil Co.) along with 40 G of Piccolyte S-115 and 180 g of a 20% solution of Solprene 1205 (a trade name of a styrene-butadiene copolymer of Ashai Kasei K.K.) in toluene with an attriter (a dispersing machine) for three hours. 30 ml of the dispersed mixture thus obtained and 60 mg of lecithin were dispersed sufficiently in 800 g of Isopar H to prepare a liquid developer "I".

On the other hand, a dispersed solution consisting of 100 g of a finely crystallized cadmium sulfide, 10 g of a 50% solution of vinyl chloride-vinyl acetate copolymer in toluene and 80 g of toluene was coated onto an aluminum foil of 0.05 mm in thickness so that the thickness of the coating might be 40 microns after drying. A polyester film of 38 microns in thickness was adhered to the surface of the coating with a cold setting adhesive of an epoxy resin to prepare a photosensitive member of three layer structure. The photosensitive member was subjected to corona charging at +7 KV and subsequently it was subjected to alternating current corona charging at 7 KV simultaneously with imagewise exposure. The entire surface of the photosensitive member was uniformly exposed to form an electrostatic latent image, which was developed with the foregoing liquid developer to obtain a good positive image.

The transfer paper "A" was brought into contact with the positive image and subjected to charging at +6 KV from the back side and then the transfer paper was peeled off so that the image formed on the photosensitive member was substantially perfectly tranferred to the transfer paper. It was found that the transferred image was clear and of a high density and was perfectly fixed by a thermal fixation. On the other hand, the same test was conducted with respect to the transfer paper "B" to obtain substantially the same result.

The degree of deterioration of the liquid developer due to the material eluted into the carrier liquid from the transfer papers "A" and "B" when they were immersed in the liquid developer was tested in the following manner to obtain the result as shown in Table 1.

Procedure of elution test:

20 sheets of each of the transfer papers A and B of A-4 size (20.8 cm ×29.5 cm size) were immersed in the liquid developer "I" for 24 hours, and then each liquid developer was used to carry out development in the foregoing manner. The density of the image obtained on the tranfer papers "A" and "B" was measured by means of a reflection densitometer.

Table 1

| | Image density (*) | Fog density (*) |
|---|---|---|
| Transfer paper A (for comparison) | 0.63 | 0.05 |
| Transfer paper B (this invention) | 1.20 | 0.02 |

Note:
(*) Both were obtained by using the liquid developer in which the transfer paper was immersed for 24 hours.

As the result of the infrared spectroscopy and emission spectroanalysis with respect to the liquid developer in which the transfer paper "A" was immersed, rosin aluminum soap was found to be eluted therefrom. In case of the liquid developer in which the transfer paper "B" was immersed, however, no rosin aluminum soap was confirmed.

EXAMPLE 2

To the starting material consisting of 100 parts of a hardwood bleached kraft pulp (L.BKP) beated up to a freeness of 420 ml were added 1.0 part of rosin size, 0.7 part of aluminum sulfate and 8 parts of talc to make a base paper "C" having a base weight of 60 g/m$^2$ by using a Fourdrinier paper machine. An electrically conductive polymer of a quaternary ammonium salt (CP-261, a trade name of a product of Calgon Corp.) was applied to the base paper to render it relatively electrically conductive.

Further, a composition of the following components was dispersed with a porcelain ball mill for 6 hours.

| | |
|---|---|
| Photoconductive zinc oxide | 100g |
| Styrene-butadiene copolymer (50% toluene solution) | 40g |
| Tolene | 120g |
| Rose Bengal (1% methanol solution) | 4ml |

The dispersed composition was coated on to the above-mentioned base paper "C" with a wire bar in order that the coating might be 40 microns in thickness after drying and the solvent was evaporated while subjecting the coating to warm air to prepare a zinc oxide photosensitive paper "C" as conventionally used.

On the other hand, another base paper "D" was made by repeating the same procedure as that in making the base paper "C" except that a condensate obtained from 1.5 mole of epichloro-hydrin and 1.2 mole of stearylaminic was substituted for the rosin size, followed by heating and drying under a weak alkaline condition. The surface thereof was treated to render it electrically conductive in the same manner as that in case of the base paper "C", and subsequently a zinc oxide photosensitive paper "D" for the purpose of the present invention was prepared in the same manner.

In the meantime, a composition of the below-listed components was dispersed and mixed with a porcelain ball mill for about 20 hours.

| | |
|---|---|
| Carbon black | 4g |
| Rosin modified alkyd rosin (20% oxylene solution) | 20g |
| Cyclized rubber (20% xylene solution) | 40g |
| Zirconium octenate | 1g |
| Isopar II | 130g |

This dispersed liquid (20 ml) was further dispersed in 2 liters of Isopar H to prepare a liquid developer II.

The entire surface of both of the zinc oxide photosensitive papers "C" and "D" prepared in the foregoing manner were subjected to uniform corona charging at −6 KV and subsequently subjected to imagewise exposure to form an electrostatic latent image on each photosensitive paper. The latent image was developed with the liquid developer II to obtain a clear image in both cases.

In order to test the degree of deterioration of the liquid developer due to the material eluted into the carrier liquid from the photosensitive papers "C" and "D" when they were separately immersed in the liquid developer, the same procedure as that in Example 1 was conducted to obtain the result as shown in Table 2.

Table 2

| | Image density (*) | Fog density (*) |
|---|---|---|
| Photosensitive paper C | 0.7 | 0.06 |

Table 2-continued

| | Image density (*) | Fog density (*) |
|---|---|---|
| Photosensitive paper D | 1.19 | 0.02 |

Note:
Both were obtained by using the liquid developer in which the photosensitive paper was immersed for 24 hours.

EXAMPLE 3

To the starting material consisting of 25 parts of softwood bleached kraft pulp (N.BKP) and 75 parts of hardwood bleached kraft pulp (L,BKP) which were beat to a freeness of 350 ml were added 1.0 part of rosin size, 0.7 part of aluminum sulfate and 8 parts of talc to make a base paper "E" having a base weight of 60 g/m$^2$ by means of a Fourdrinier paper machine. The base paper thus made was treated with a 10% aqueous solution of sodium alginate by means of a size press to give it a surface specific resistance of $10^5$ ohm-cm. Onto the surface of the base paper thus treated, a 20% solution of a copolymer of vinyl acetate, vinyl chloride and styrene in toluene was coated in an amount of 7 g/m$^2$ with a roll coating machine to prepare an electrostatic recording paper "$E_1$".

On the other hand, another base paper was made in the same manner as above except that a mixture of decylketene dimer and sodium salt of carboxymethyl cellulose (1:3) was substituted for the rosin size used for making the aforementioned base paper "$E_1$" and it was treated in the same manner by using sodium alginate as mentioned above. A vinyl acetate-vinyl chloridestyrene copolymer resin was coated onto the treated base paper to prepare an electrostatic recording paper "$E_2$".

The recording papers "$E_1$" and "$E_2$" were tested with respect to various properties by using the liquid developer I which was prepared in Example 1. The result of the test is shown in Table 3.

Table 3

| | Surface specific resistance (ohm/cm) | Fog density | Record density |
|---|---|---|---|
| Recording paper $E_1$ | $3 \times 10^{14}$ | 0.03 | 1.3 |
| Recording paper $E_2$ | $1 \times 10^{14}$ | 0.03 | 1.25 |

The test on the effect of the material eluted into the carrier liquid from the recording papers "$E_1$" and "$E_2$" was carried out in the same manner as in Example 1 to obtain the result as shown in Table 4.

Table 4

| | Recorded image density (*) | Volume specific resistance (*) of the liquid developer (ohm/cm) |
|---|---|---|
| Recording paper $E_1$ | 0.6 | $2 \times 10^{10}$ |
| Recording paper $E_2$ | 1.25 | $3 \times 10^{12}$ |

Note:
(*) Both were obtained by using the liquid developer in which the recording paper was immersed for 24 hours

EXAMPLE 4

To the starting material of 100 parts of a hardwood bleached kraft pulp (L.BKP) beat to a freeness of 440 ml were added 0.6 part of rosin size, 2.0 parts of aluminum sulfate and 5 parts of talc to make a base paper having a base weight of 52 g/m$^2$ by using a Fourdrinier paper machine. A size press solution consisting of 50 parts of oxidized starch 50 parts of clay for coating and 500 parts of water was coated onto the base paper in an amount of 6 g/m$^2$ as solid, by means of a size press. The coating of the under-mentioned composition was coated onto both sides of the base paper, onto which the size press solution had been coated, in an amount of 4 g/m$^2$ per one side by using an air-knife coater to obtain a transfer paper "G" as conventionally used which exhibited a Gurley densometer reading of 4000 seconds, a hold out of 8 seconds and a curl of 5 mm.

Composition of the coating for both sides:

Emulsion of ammonium salt of a copolymer of 75 mole% of ethyl acrylate, 5 mole% of butyl acrylate and 20 mole% of methacrylic acid . . . 19 parts.

Polyvinyl alcohol (PVA105, a trade name of a product of Kuraray Co. Ltd.) . . 5 parts

| | |
|---|---|
| Oxidized starch | 4 parts |
| Clay for coating | 72 parts |
| Antifoaming agent (silicone type) | 0.1 part |
| Sodium pyrophosphate | 0.5 parts |
| Calcium stearate | 0.5 parts |
| Water | 400 parts |

On the other hand, among the materials for making the above-mentioned base paper, a mixture of decylketene dimer and polyvinylamine (2:1) was substituted for the rosin sizing agent to make another base paper. The base paper thus obtained was treated in the same manner as described above to obtain a transfer paper "H" according to the present invention.

The elution test was carried out with respect to each of the transfer papers "G" in the same manner as in Example 1 to give the result as indicated in Table 5.

Table 5

| | Image density (*) | Fog density (*) |
|---|---|---|
| Transfer paper G | 0.51 | 0.06 |
| Transfer paper H | 1.23 | 0.02 |

Note:
(*) Both were obtained by using the liquid developer in which the transfer paper was immersed for 24 hours.

EXAMPLE 5

The same procedure as that in Example 1 was repeated except that a mixture of stearic acid amide and sodium palmitate was substituted for the rosin size. The result of the comparison test conducted in the same manner as in Example 1 was substantially the same.

EXAMPLE 6

The same procedure as that in Example 1 was repeated except that a colloidal dispersed liquid of polyethylene was substituted for the rosin sizing agent. The comparison test was carried out in the same manner as that in Example 1 to give substantially the same result.

EXAMPLE 7

The same procedure as that in Example 1 was repeated except that a mixture of a paraffin wax emulsion and sodium palmitate (1:2) was substituted for the rosin sizing agent. The same comparison test as that in Example 1 was carried out to obtain substantially the same result.

EXAMPLE 8

The same procedure as that in Example 4 was repeated except that an emulsion of triacetoxysilane was substituted for the rosin sizing agent which was a material for making the base paper to conduct the same comparison test as that in Example 4. The result was substantially the same.

EXAMPLE 9

The same procedure as that in Example 2 was repeated except that potassium stearate and sodium aluminate were substituted for the rosin sizing agent and aluminum sulfate, respectively which were materials for making the base paper. The comparison test was conducted in the same manner as that in Example 2 to give substantially the same result.

EXAMPLE 10

The same procedure as that in Example 1 was repeated except that a saponified dodecenyl succinic anhydride was used in place of the rosin sizing agent to conduct the same comparison test. The obtained result was substantially the same as that in Example 1.

EXAMPLE 11

The same procedure as that in Example 1 was repeated except that a reaction product of a terpene resin and acrylonitrile was used in place of the rosin sizing agent to carry out the comparison test in the same manner as that in Example 1. The obtained result was substantially the same.

EXAMPLE 12

To the starting material consisting of 20 parts of a softwood bleached kraft pulp (N.BKP) and 80 parts of a hardwood bleached kraft pulp (L.BKP) which were beat to a freeness of 400 ml were added 0.4 part of rosin size, 1.5 parts of aluminum sulfate, (the mole ratio of rosin size/aluminum sulfate = 1/39) and 8 parts of talc, to which sodium aluminate was added to adjust the pH value to 4.5-5. A base paper "a" having a base weight of 60 g/m$^2$ was made by means of a Fourdrinier paper machine.

On the other hand, a base paper "b" was made in the same manner as that in making the base paper "a" by using 1 part of rosin size and 0.76 part of aluminum sulfate (the mole ratio of rosin size/aluminum sulfate = 1.5/1).

The size press solution of the composition as given below was coated onto the base paper "a" in an amount of 3 g/cm$^2$ (as solid) to prepare a transfer paper "I" according to the present invention. Also, it was coated onto the base paper "b" in an amount of 3 g/cm$^2$ in the same manner to prepare a transfer paper "J" for comparison.

Composition of the size press solution:

Emulsion of a copolymer of 50 mole% of ethyl acrylate, 20 mole% of methyl methacrylate and 30 mole% of acrylic acid . . . 80 parts Methyl cellulose (Methorose 658 H, a trade name of a product of Shinetsu Kagaku K.K.) . . . 0.7 part Clay . . . 30 parts Melamine resin (Sumilez 613, a trade name of a product of Sumitomo Kagaku K.K.) . . . 0.5 part Antifoaming agent (a silicone type) . . . 0.1 part Dispersing agent (Plimal 850, a trade name of a product of Nippon Akuriru Kagaku K.K.) . . . 0.02 part Water . . . 900 parts The same comparison as that in Example 1 was carried out with respect to the transfer papers "I" and "J" to give the result as shown in Table 6.

Table 6

| | Image density (*) | Fog density (*) |
|---|---|---|
| Transfer paper 1 | 1.20 | 0.02 |
| Transfer paper J | 0.54 | 0.05 |

Note:
(*) Both were obtained by using the liquid developer in which the transfer paper was immersed for 24 hours As the result of the infrared spectroscopy and emission spectroanalysis with respect to the liquid developer in which the transfer paper "I" was immersed, it was found that rosin aluminum soap was hardly eluted from the transfer paper. However, in case of the liquid developer in which the transfer paper "J" containing a larger mole raio of the used rosin size was immersed, rosin aluminum soap was clearly confirmed to be eluted.

EXAMPLE 13

An electrically conductive polymer of a quaternary ammonium salt (CP-261, a trade name of a product of Calgon Corp.,) was coated onto each of the base papers "a" and "b" made in Example 12 to render then electrically conductive.

| | |
|---|---|
| Photoconductive zinc oxide | 100g |
| Copolymer of styrene and butadiene (50% tolene solution) | 120g |
| n-butyl methacrylate (50% tolene solution) | 40g |
| Toluene | 120g |
| Rose Bengal (1% methanol solution) | 4ml |

The composition of the above-listed component was dispersed with a porcelain ball mill for 6 hours. The dispersed liquid was coated with a wire bar onto each of the base papers "a" and "b" to render them electrically conductive in order that each coating might be 40 microns in thickness after drying. The solvent was evaporated while subjecting the coating to warm air to prepare zinc oxide photosensitive papers "K" and "L".

| | |
|---|---|
| Carbon black | 4g |
| Rosin modified alkyl resin (20% xylene solution) | 20g |
| Cyclized rubber (20% xylene solution) | 40g |
| Zirconium octenate | 1g |
| Isopar H | 130g |

The composition of the above-mentioned components was dispersed and mixed with a porcelain ball mill for about 20 hours, and then 35 ml of the dispersed mixture was further dispersed in 2 liters of Isopar G (b.p. 158°-177° C.) to prepare a liquid developer.

The above-mentioned zinc oxide photosensitive papers "K" and "L" were separately subjected to uniform corona charging at −6 KV over their entire surface and then subjected to imagewise exposure to form an electrostatic latent image on each of them. Each image thus formed was developed with the above-mentioned liquid developer to obtain a clear image free from fog in each case.

The test was carried out in the same manner as that in Example 1 in order to examine the degree of deterioration of the liquid developer due to the material eluted into the carrier liquid from the photosensitive papers "K" and "L" when they were separately immersed in the liquid developer. The result was as shown in Table 7.

Table 7

| | Image density (*) | Fog density (*) |
|---|---|---|
| Photosensitive paper K | 1.15 | 0.02 |
| Photosensitive paper L | 0.8 | 0.05 |

Note:
(*) Both were obtained by using the liquid developer in which the photosensitive paper was immersed for 24 hours.

EXAMPLE 14

To the starting material consisting of 25 parts of a softwood bleached kraft pulp (N.BKP) and 75 parts of a hardwood bleached kraft pulp (L.BKP) which were beat to a freeness of 350 ml were added 0.7 part of rosin sixze, 2 parts of aluminum sulfate, (the mole ratio of rosin size / aluminum sulfate = 1/2.5) and 8 parts of talc to make a base paper "C" having a base weight of 60 g/m$^2$ by using a Fourdrinier paper machine. On the other hand, 1 part of rosin size and 0.58 part of aluminum sulfate, (the mole ratio of rosin size / aluminum sulfate = 2/1) were used to make a base paper "d" in the same manner as in making the base paper "c". The base papers "c" and "d" were separately treated with a 10% aqueous solution of sodium alginate by means of a size press to give them a surface specific resistance of $10^5$ ohm/cm. A 20% solution of vinyl acetate-vinyl chloride-styrene copolymer resin in toluene was coated onto each of the base papers thus treated in an amount of 7 g/cm$^2$ with a roll coating machine to prepare electrostatic recording papers "M" and "N".

| | |
|---|---|
| Copper phthalocyanine blue | 50g |
| Cumarone resin (50% xylene solution) | 300g |
| Cyclized rubber (25% xylene solution) | 200g |
| Polyethylene of low molecular weight (50% xylene solution) | 50g |
| Isopar K (b.p. 177°-204° C.) | 800g |

The mixture of the above-listed materials was kneaded and dispersed with an attriter for 3 hours and then 30 ml of the dispersed mixture and 0.05 g of aerosol OT were dispersed in 800 g of Isopar K to prepare a liquid developer. Various properties of the above-mentioned recording papers "M" and "N" were tested by using the liquid developer thus prepared to obtain the result shown in Table 8.

Table 8.

| | Surface specific resistance (ohm/cm) | Fog density | Image density |
|---|---|---|---|
| Recording paper M | $4 \times 10^{14}$ | 0.03 | 1.12 |
| Recording paper N | $4.5 \times 10^{14}$ | 0.03 | 1.10 |

The test with respect to the effect of the material eluted from the recording papers "M" and "N" into the carrier liquid of the liquid developer was carried out in the same manner as that in Example 1 to obtain the result as shown in Table 9.

Table 9

| | Record density (*) | Fog density (*) |
|---|---|---|
| Recording paper M | 1.12 | 0.02 |
| Recording paper N | 0.70 | 0.05 |

Note: (*)
Both were obtained by using the liquid developer in which the recording paper was immersed for 24 hours.

EXAMPLE 15

To the starting material consisting of 25 parts of a softwood bleached kraft pulp (N.BKP) and 75 parts of a hardwood bleached pulp (L.BKP) which were beat to a freeness of 350 ml were added 0.7 part of rosin size, 4 parts of aluminum sulfate, (the mole ratio of rosin size/aluminum sulfate = 1/5) and 8 parts of talc to make a base paper "$c_1$" of 62 g/m$^2$ by using a Fourdrinier paper machine.

On the other hand, 1 part of rosin size agent and 0.58 part of aluminum sulfate (the mole ratio of rosin size/aluminum sulfate = 2/1) were used to make a base paper "$d_1$" in the same manner as that in making the base paper "$c_1$". These base papers "$c_1$" and "$d_1$" were used to prepare transfer papers, photosensitive papers and electrostatic recording papers in the same manner as that in Examples 12, 13 and 14. These types of papers were subjected to the same comparison test as that in Examples 12, 13 and 14 to obtain substantially the same results.

We claim:

1. In an electrophotographic process including the steps of
   (a) forming a toner image on a support by developing an electrostatic latent image on said support with a liquid developer comprising toner particles dispersed in a highly insulating carrier liquid;
   (b) transferring said toner image onto a transfer paper containing, as a sizing agent, rosin size and aluminum sulfate, by contacting said toner image with said transfer paper and applying an electric field thereto;
   (c) recovering and combining any nontransferred liquid developer remaining on said support with the liquid developer employed in step (a) for reuse in subsequent developing steps; and
   (d) repeating steps (a)-(c);
   wherein the improvement comprises suppressing the accelerated deterioration of the liquid developer during such repeated use by using a transfer paper containing rosin size and aluminum sulfate in amounts such that a substantial amount of rosin aluminum soap is not eluted into said nontransferred liquid developer during said transferring step (b), and wherein said amounts are such that the amount of rosin aluminum soap eluted from the transfer paper into said carrier liquid is not more than 20 mg., said amount being determined by immersing 200 g. of small pieces of said transfer paper in one liter of said carrier liquid of the liquid developer, and allowing the carrier liquid containing said small pieces of transfer paper to stand for 24 hours.

2. An electrophotographic process according to claim 1 wherein the amounts of rosin size and aluminum sulfate in said transfer paper are such that the amount of rosin aluminum soap eluted from the transfer paper into said carrier liquid is not more than 10 mg., said amount being determined by immersing 200 g. of small pieces of said transfer paper in one liter of said carrier liquid of the liquid developer, and allowing the carrier liquid containing said small pieces of transfer paper to stand for 24 hours.

3. In an electrophotographic process including the steps of
   (a) forming a toner image on a support by developing an electrostatic image on said support with a liquid developer comprising toner particles dispersed in a highly insulating carrier liquid;

(b) transferring said toner image onto a transfer paper containing, as a sizing agent, rosin size and aluminum sulfate, by contacting said toner image with said transfer paper and applying an electric field thereto;

(c) recovering and combining any nontransferred liquid developer remaining on said support with the liquid developer employed in step (a) for reuse in subsequent developing steps; and (d) repeating steps (a)–(c);

wherein the improvement comprises suppressing the accelerated deterioration of the liquid developer during such repeated use by using a transfer paper containing rosin size and aluminum sulfate, wherein the amount of rosin size is not more than an equimolar amount based on the amount of aluminum sulfate, such that a substantial amount of rosin aluminum soap is not eluted into said nontransferred liquid developer during said transferring step (b).

4. A process according to claim 3, wherein the molar ratio of rosin size to aluminum sulfate is from 1:2 to 1:5.

* * * * *